US005603137A

United States Patent [19]

Hasan

[11] Patent Number: 5,603,137

[45] Date of Patent: Feb. 18, 1997

[54] BRUSH WITH CLEANING ATTACHMENT

[76] Inventor: Tariq Hasan, 84-11 150th St., Briarwood, N.Y. 11435

[21] Appl. No.: 504,833

[22] Filed: Jul. 20, 1995

[51] Int. Cl.[6] ..... A46B 17/06

[52] U.S. Cl. ..... 15/176.1; 15/105; 15/142; 15/169; 15/246; 119/628

[58] Field of Search ..... 15/142, 159.1, 15/160, 176.1, 246, 169, 105; 119/88; 132/119

[56] References Cited

U.S. PATENT DOCUMENTS

| | | | |
|---|---|---|---|
| 1,183,528 | 5/1916 | Bongiovanni | 15/142 |
| 1,546,548 | 7/1925 | MacCune . | |
| 1,689,209 | 10/1928 | Majewski . | |
| 2,060,018 | 11/1936 | Bernz . | |
| 2,564,721 | 8/1951 | Raya . | |
| 2,781,739 | 2/1957 | Dick | 15/159.1 |
| 2,866,221 | 12/1958 | Warva . | |
| 3,170,182 | 2/1965 | Burian . | |
| 3,172,139 | 3/1965 | Wire | 15/246 |
| 3,369,265 | 2/1968 | Halberstadt et al. | 15/176.1 |
| 3,384,921 | 5/1968 | Loston . | |
| 4,517,703 | 5/1985 | Koke | 15/246 |

FOREIGN PATENT DOCUMENTS

| | | | |
|---|---|---|---|
| 2068595 | 11/1993 | Canada | 15/246 |

*Primary Examiner*—David Scherbel
*Assistant Examiner*—Terrence R. Till
*Attorney, Agent, or Firm*—Dilworth & Barrese

[57] ABSTRACT

A brush having a head portion including a receiving part and an array of bristles extending from a surface of the head portion, and a removable handle portion having a projecting part that interfaces with the receiving part to secure the handle portion with the head portion. The projecting part is extendable through the array of bristles substantially adjacent the surface from which the bristles project and movable away from the surface in the direction of projection of the bristles. The movement of the projecting part away from the surface along the bristles removes material collected adjacent the surface and the bristles.

15 Claims, 6 Drawing Sheets

Fig. 9
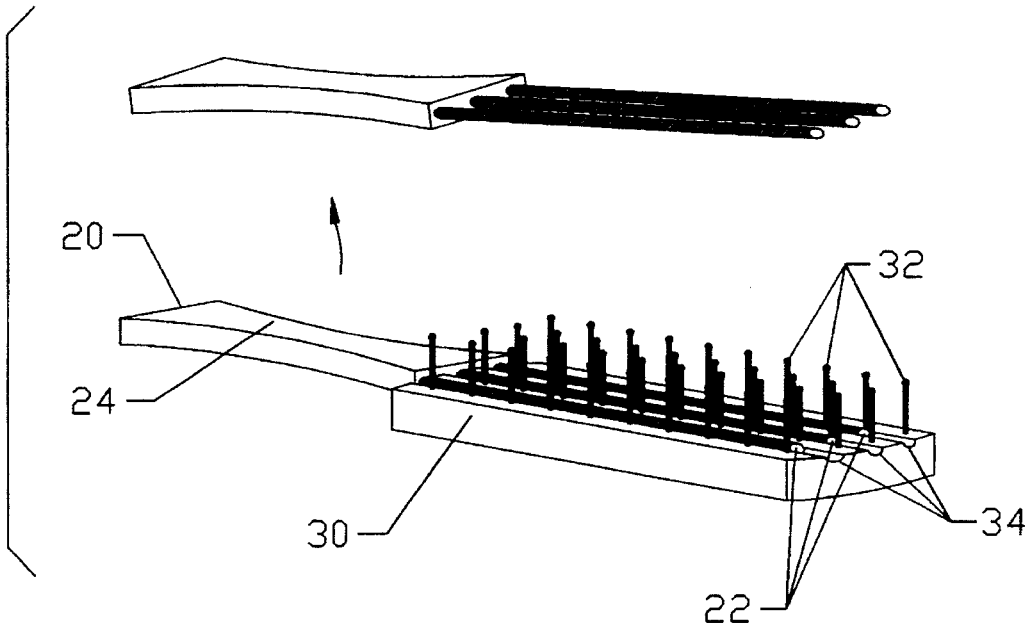
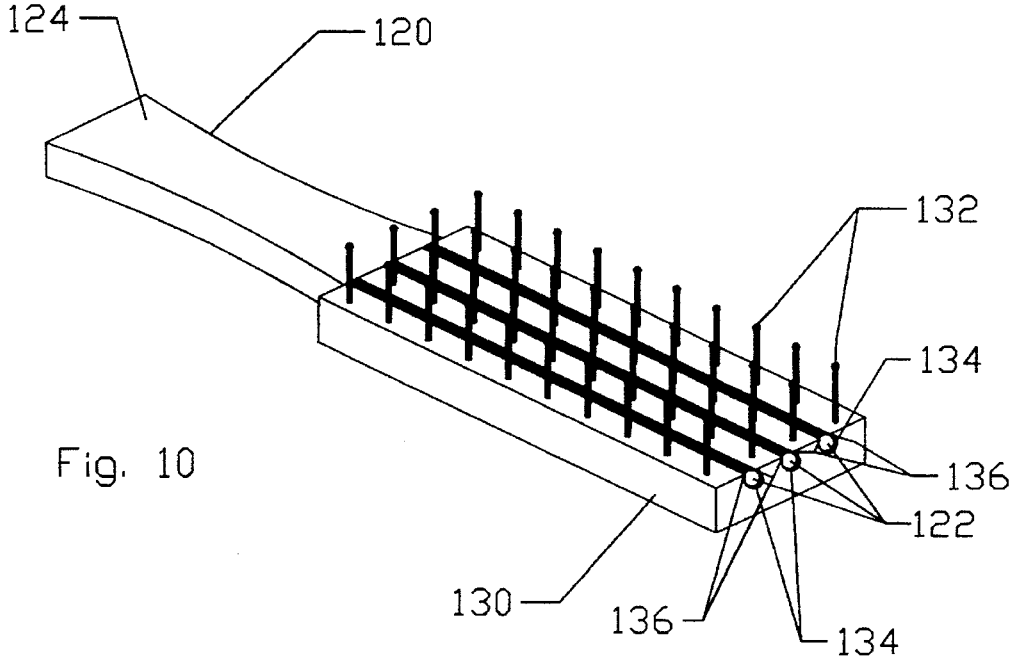
Fig. 10

BRUSH WITH CLEANING ATTACHMENT

This application is related to Disclosure Document No. 368584.

BACKGROUND OF THE INVENTION

1. Field of the Invention

The present invention relates to grooming apparatus and, more specifically, to brushes.

2. Description of the Related Art

Hair brushes abound in the present era. Even a cursory view of the relevant aisle of any large drug store indicates that hair care and, more particularly, hair brushes, play an increasingly important role in grooming. Furthermore, since at least the 1970s, there has been an increasing popularity in men's hair styling. Thus, hair care products for both women and men, including hair brushes, have become big sellers.

Even as the number and styles of brushes seem to increase without bounds, devices for cleaning brushes, including simply removing hair that accumulates in the bristles, are primitive. A review of the patent art illustrates the undeveloped state of the art, and, most likely, most people simply replace their brushes, rather than clean them with brush cleaning devices.

For example, U.S. Pat. No. 2,564,721 to Raya shows a rake-like device that is run through the bristles. The technique is similar to the home grown method of cleaning the bristles of a brush with a comb. It is directed toward brushes with flexible groupings of bristles, and would not work on brushes with hard plastic bristles used in blow drier hair styling that is popular today. Furthermore, the user must pack or carry two items—the brush and the cleaning device. U.S. Pat. No. 1,546,548 to MacCune describes a brush holder that also includes brush cleaning teeth, which is also similar to using a comb to clean a brush. This does not even present the option of carrying the cleaning device along with the brush.

Another example of a device intended to clean brushes is U.S. Pat. No. 1,689,209 to Majewski, which shows a backing plate with a series of holes through which the bristles extend. The plate is normally adjacent the surface of the brush from which the bristles extend. When the brush is to be cleaned, the plate pivots over the bristles. The pivoting plate would not work well with brushes with flexible groupings of bristles because, once the holes passed over the ends of the bristles, they would spread out and be difficult to reinsert. Nor would the pivoting geometry work well with brushes having hard plastic bristles, because the bristles would need to bend as the plate pivoted. Once the hard plastic bristles were to pass through the holes of the plate, replacement of the plate to its original position would require bending the bristles into the holes.

It would be extremely beneficial to provide a brush with a cleaning feature that is incorporated within the brush itself, and that works well with many different styles of brushes.

In particular, it would be beneficial to provide a brush with a cleaning feature that is lifted through the rows of bristles for cleaning, instead of raked through the bristles.

SUMMARY OF THE INVENTION

In accordance with the present invention, a brush is provided comprising a head portion including a receiving part and an array of bristles extending from a surface of the head portion, and a removable handle portion having a projecting part that interfaces with the receiving part to secure the handle portion with the head portion. The projecting part is extendable through the array of bristles substantially adjacent the surface from which the bristles project and movable away from the surface in the direction of projection of the bristles. The movement of the projecting part away from the surface along the bristles removes material collected adjacent the surface and the bristles.

BRIEF DESCRIPTION OF THE DRAWINGS

The features of the present invention will be better understood and become readily apparent by referring to the following detailed descriptions of illustrative embodiments, taken in conjunction with the accompanying drawings, in which:

FIG. 9 is a perspective view of the brush with tines of the handle portion completely inserted in grooves in the head portion;

FIG. 10 is a perspective view of a second embodiment of a brush of the present invention.

DETAILED DESCRIPTION OF THE PREFERRED EMBODIMENTS

Figure 1:
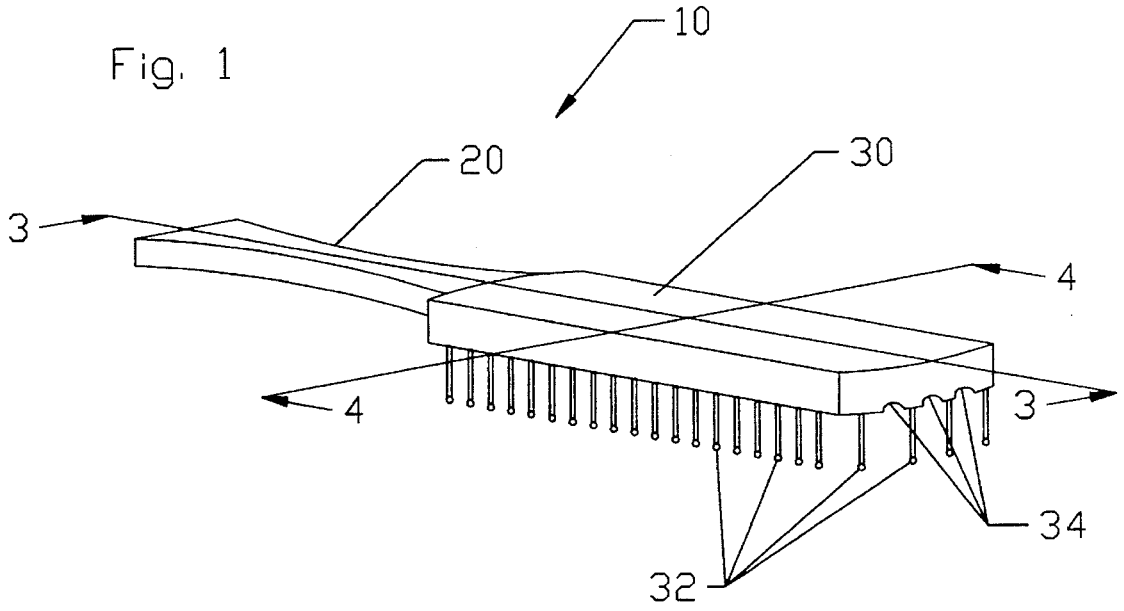
FIG. 1 is a top perspective view of a brush of the present invention.
Figure 2:
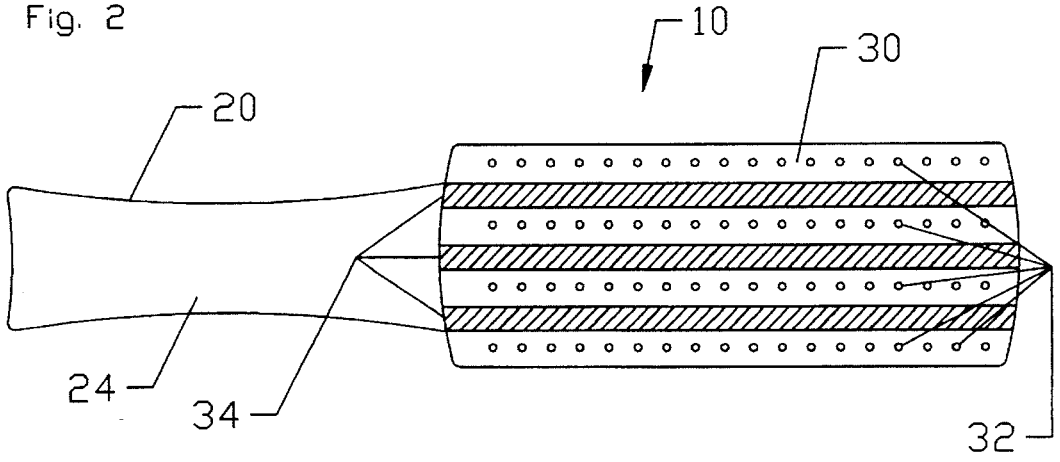
FIG. 2 is a bottom plan view of the brush shown in FIG. 1.

Referring now to the drawings, FIG. 1 is a top perspective view of a brush 10 of the present invention. The brush 10 is comprised of a handle portion 20 typically made of a hard plastic, and a head portion 30. The bulk of the head 30 is preferably made of a hard, pliable rubber or plastic and may be contained within a partial shell of hard plastic (not shown in the figures). As described further below, handle portion 20 is detachable from head portion 30. Extending from a surface of the head portion 30 are rows of bristles 32. (For purposes of clarity, the surface of the head portion 30 from which the bristles 32 extend is hereinafter referred to as the "bottom surface" of the head portion 30.) Parallel grooves 34 between each row of bristles 32 extend the length of the bottom surface of the head portion 30. Referring to FIG. 2, a bottom view of the brush 10 of FIG. 1, the parallel grooves 34 and rows of bristles 32 are fully visible.

Figure 3:
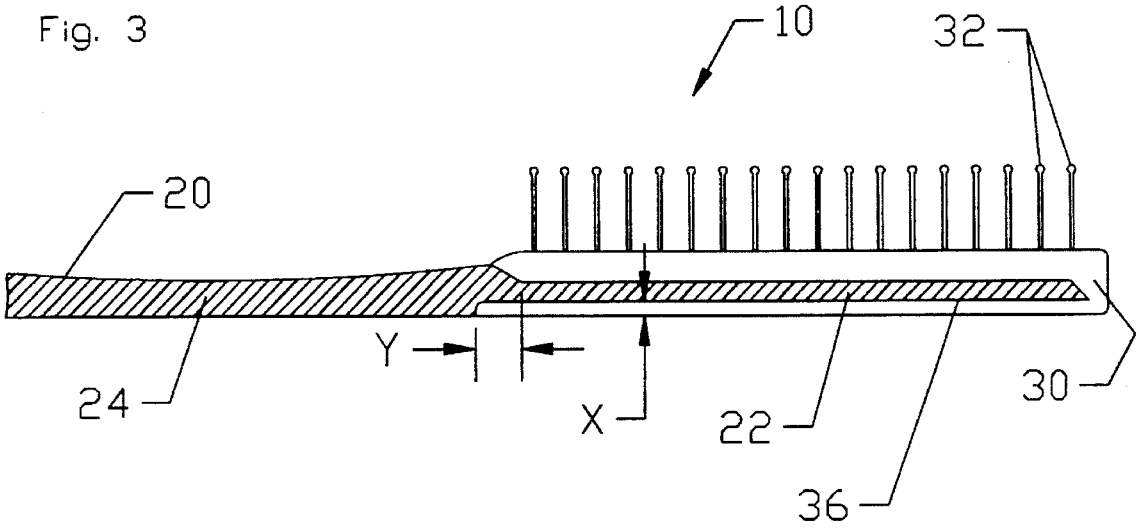
FIG. 3 is a cross-sectional view of the brush of FIG. 1, taken along lines 3—3.
Figure 4:
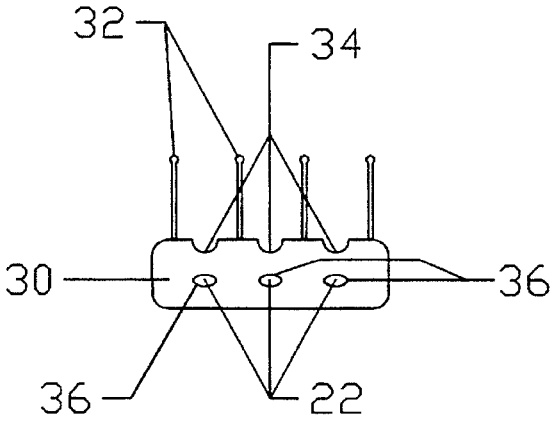
FIG. 4 is a cross-sectional view of the brush of FIG. 1, taken along lines 4—4.
Figure 5:
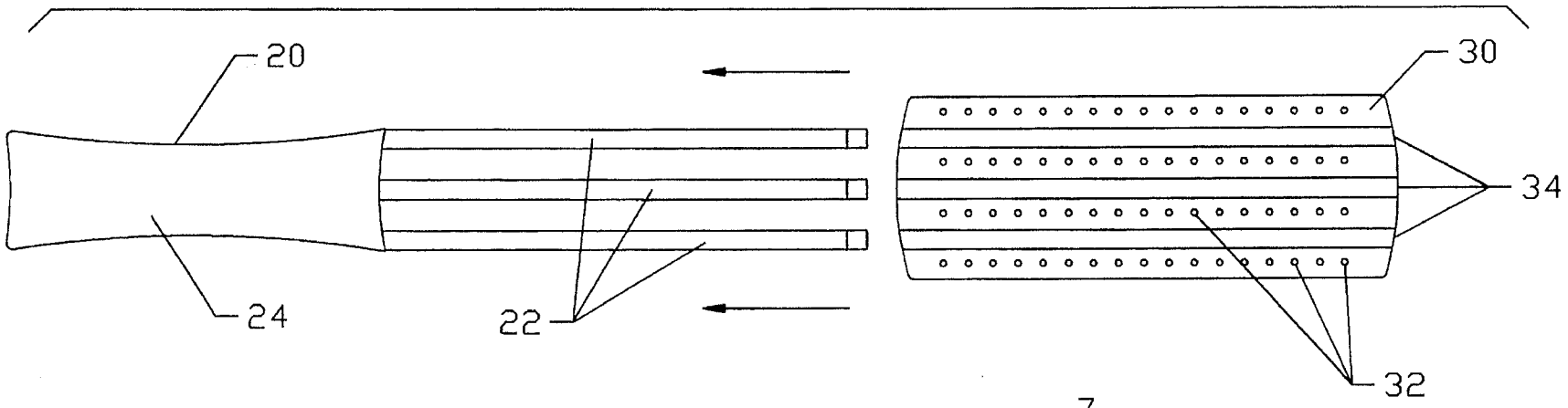
FIG. 5 is a bottom view of the brush of FIG. 1 with the handle portion separated from the head portion.

The detachable feature of the brush 10 referred to above is shown by referring to FIGS. 3–5 together. FIG. 3 is a cross-sectional view along the length of the brush 10, and FIG. 4 is a cross-sectional view across the head 30 of the brush 10. As pictured, handle portion 20 has three parallel tines 22 extending from the grip 24 that are received by parallel passages 36 extending through the head 30. The parallel passages 36 have a cross-section that is slightly less than the cross-section of the tines 22 of the handle portion 20. Thus, when the tines 22 are received in the parallel passages 36, the hard rubber material of the head portion 30 surrounding the passages 36 is compressed so that there is a frictional engagement between the tines 22 and the passages 36. The handle portion 20 is consequently secured to the head portion 30 and in this configuration may be used for brushing hair. (The handle portion 20 may alternatively, or in addition, be secured to the head portion 30 by a "snap" feature, comprised of, for example, a detent or ridge on the handle portion 20 that interfaces with a recess in the head portion 30 when the handle portion is received therein.)

The handle portion 20 may be removed from the head portion 30 by pulling the grip 24 of the handle portion 20 away from the head portion 30, thereby removing the tines 22 from the parallel passages 36, as shown in FIG. 5.

Figure 6:
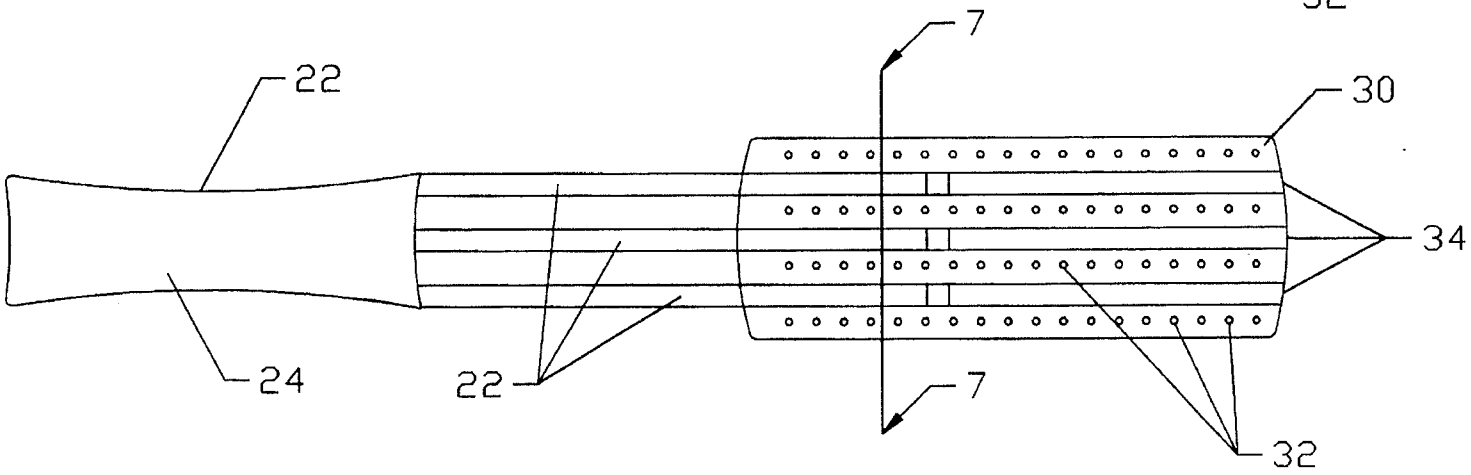
FIG. 6 is a bottom view of the brush as shown in FIG. 5, with tines of the handle portion partially inserted in grooves in the head portion.
Figure 7:
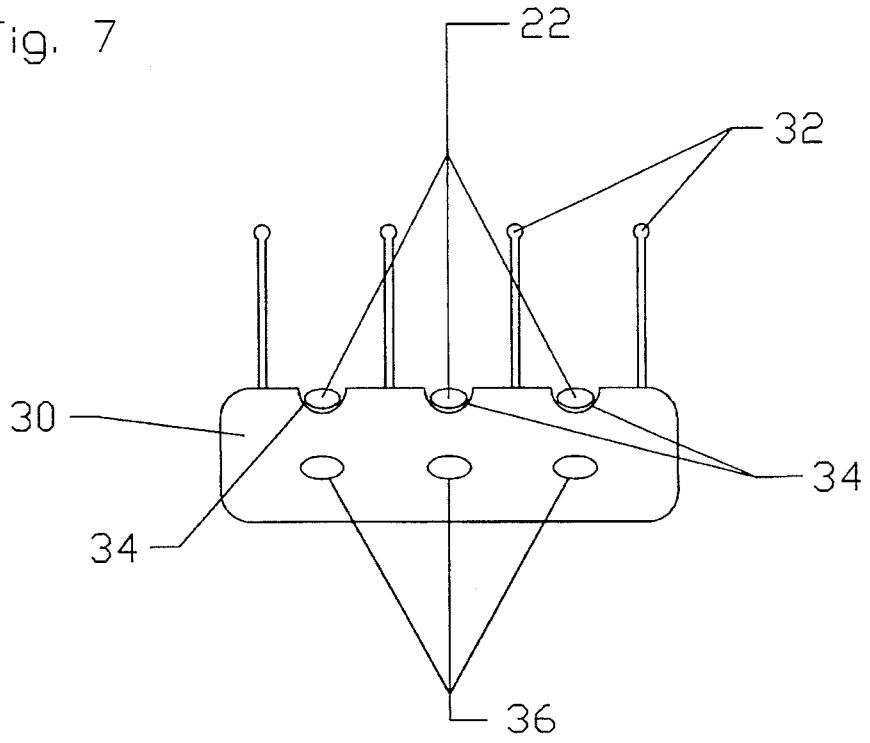
FIG. 7 is a cross-sectional view of the brush as configured in FIG. 6, taken along lines 6—6.

Referring back to FIG. 4, it is seen that parallel grooves 34 in the bottom surface of the head 30 are spaced apart by the same distance as parallel passages 36. Thus, when removed from the passages 36, tines 22 may be advanced lengthwise into parallel grooves 34, as shown in FIG. 6. Further, as shown in FIG. 7, the parallel grooves 34 have cross-section sufficient to receive the tines 22 completely below the bottom surface of the head 30. In addition, as seen most clearly in FIG. 3, the tips of the tines 22 are bevelled so that they remove debris from the grooves 34 as they are inserted.

Figure 8:
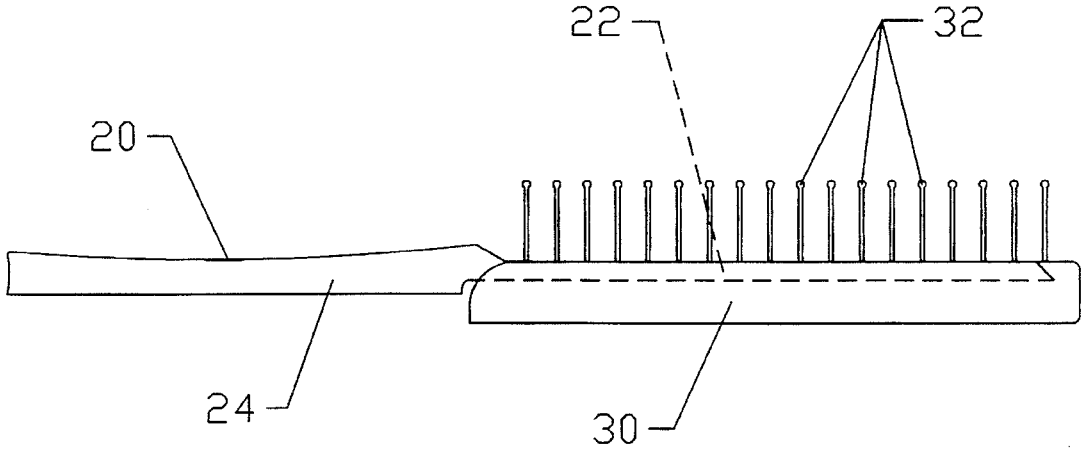
FIG. 8 is a side-view of the brush with tines of the handle portion completely inserted in grooves in the head portion.
Figure 12:
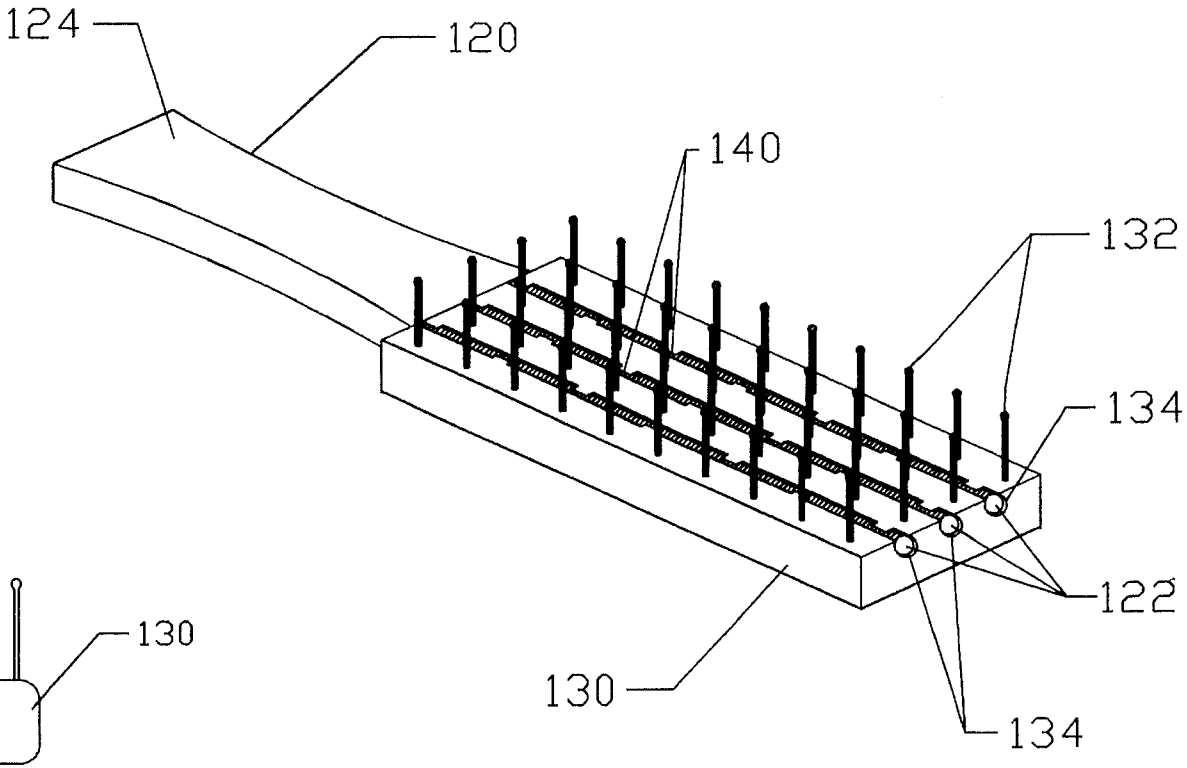
FIG. 12 is a schematic representation in perspective of a brush of the present invention.

Referring back to FIG. 3, the offset (marked X in FIG. 3) between the tines 22 and the top of the grip 24 of the handle 20 is minimized. The offset X also extends partially onto the grip 24 by a distance Y. This ensures that the tines 22 may be fully received in the grooves 34 so that the tips of the tines 22 extend beyond the bristles 32 before the grip 24 engages the head portion 30, as shown in FIG. 8. (The tines 22 are represented by broken lines in FIG. 8.)

Once the tines 22 are received in the grooves 34, the handle 20 is moved in the direction of the bristles 32, as shown in FIG. 9, so that the tines 22 are moved away from the head portion 30 and grooves 34 through the rows of bristles 32. The tines 22 clear away any hair and other debris that has accumulated among the bristles 32 and adjacent the bottom surface of the head portion 30.

Generally, the number of tines 22 on the handle portion 20 may be one less than the number of rows of bristles 32, so that there is at least one tine 22 adjacent each row of bristles 32 during cleaning. Alternatively, the number of tines 22 may be one more than the number of rows of bristles 32, so that there are tines 22 on each side of each row of bristles 32 during cleaning. This correlation of the number of tines 22 with the number of rows of bristles 32 ensures that the brush 10 may be cleaned completely with one upward movement of the tines 22.

Also, grooves 34 in the head portion 30 are optional since, even if they were absent, the tines 22 would be able to slide between the rows of bristles 32 adjacent the bottom surface of the head portion 30 due to the bevelled tips as seen in FIG. 3. Also, the grooves 34 of this embodiment need not be "grooves" per se. Instead, they may be more generally described as a receptacle lying in a plane that is substantially parallel to a plane defined by the points of intersection between the head portion 30 and the bristles 32. The plane defined by the receptacle is on the opposite side of the bristles 32 of the plane defined by the points of intersection between the head portion 30 and the bristles 32.

FIG. 10 shows an alternative embodiment of the present invention, where the parallel grooves in the bottom surface of the head also serve the function of the parallel passages of the prior embodiment, that is, securing the handle portion to the head portion for use in a normal brushing operation. Thus, there are no parallel passages in the head portion 130 in this configuration.

Figure 11:
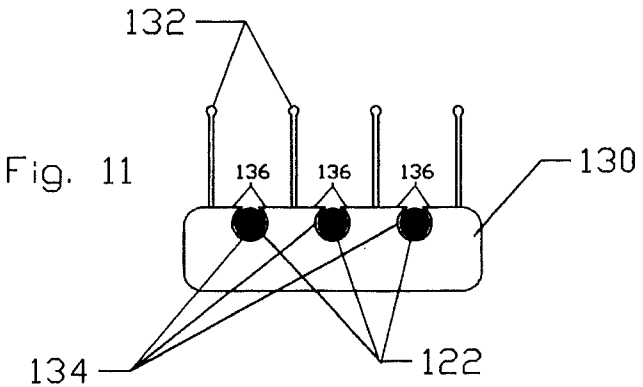
FIG. 11 is a cross-sectional view of the brush of FIG. 10, taken along lines 11—11.

As shown in FIGS. 10 and 11, the grooves 134 are further defined by ridge portions comprised of lips 136 extending the length of the grooves 134 and which partially envelop the parallel tines 122 of the handle portion 120 at the bottom surface of the head portion 130, The grooves 134 have a cross-section that is slightly less than the cross-section of the tines 122 of the handle portion 120. Thus, when the tines 122 are received in the grooves 134, the rubber or plastic material of the head 130 surrounding the grooves 134 is compressed so that there is a frictional engagement between the tines 122 and that part of the head portion 130 defining the grooves 134. The handle portion 120 is consequently secured by the tines 122 to the head portion 130 and in this configuration may be used for brushing hair. (The handle portion 120 may alternatively, or in addition, be secured to the head portion 130 by a "snap" feature, comprised of, for example, a detent or ridge on the handle portion 120 that interfaces with a recess in the head portion 130 when the handle portion is received therein.)

When the brush requires cleaning, the top of the head 130 is grasped, and a force is applied to the handle portion 120 via the grip 124 in the direction of the bristles 132. The force on the handle portion 120 presses the projections 122 against the lips 136. The lips 136, which are part of the head portion 130 and are thus made of hard pliable plastic or rubber, flex in the direction of the bristles 132 and, for a sufficient force, release the tines 122 from the groove 134. Once the tines 122 are released from the grooves 134 of the head portion 130, the tines 122 sweep upward through the bristles, similar to the motion shown in FIG. 9 of the prior embodiment.

It will be understood that various modifications can be made to the various embodiments of the present invention herein disclosed without departing from its spirit and scope. For example, the tines may be flat members that reside adjacent the bottom of the head portion between the rows of bristles, and the grip could clip to the rear of the head portion, thereby securing the handle portion to the head portion, for normal brushing operation. Also, for example, the ridge portions in the second embodiment may include one or more tabs 140 adjacent to the bottom surface of the head portion, in lieu of lips. Therefore, the above description should not be construed as limiting the invention but merely presenting preferred embodiments of the invention. Those skilled in the art will envision other modifications within the scope and spirit of the present invention as defined by the claims presented below.

What is claimed is:

1. A brush comprising:

a) a head portion including a receiving part having a number of substantially parallel passages extending through the head portion, the passages being at least partially enclosed, and an array of bristles extending away from a surface of the head portion; and b) a removable handle portion having a projecting part that interfaces with the receiving part of the head portion, the parallel passages of the receiving part being configured to receive the projecting part, the projecting part extendable through the array of bristles substantially adjacent the surface from which the bristles project and movable away from the surface in the direction of projection of the bristles;

wherein the movement of the projecting part away from the surface along the bristles removes material collected adjacent the surface and the bristles.

2. A brush as in claim 1, wherein the array of bristles project substantially perpendicular from the surface of the head portion.

3. A brush as in claim 1, wherein the surface of the head portion from which the bristles project includes a series of grooves extending along the surface.

4. A brush as in claim 1, wherein the projecting part of the handle portion includes a series of substantially parallel tines.

5. A brush as in claim 4, wherein the surface of the head portion from which the bristles project includes a series of substantially parallel grooves extending along the surface, the grooves aligned for receiving the tines of the handle portion.

6. A brush comprising:

a) a head portion including a receiving part and an array of bristles extending from a surface of the head portion, the receiving part including a series of grooves extending along the surface from which the bristles project, the receiving part of the head portion includes ridge portions adjacent the surface from which the bristles project that envelope at least in part the series of grooves and b) a removable handle portion having a projecting part that interfaces with the receiving part of the head portion, the projecting part extendable through the array of bristles substantially adjacent the surface from which the bristles project and movable away from the surface in the direction of projection of the bristles;

wherein the movement of the projecting part away from the surface along the bristles removes material collected adjacent the surface and the bristles.

7. A brush as in claim 6, wherein the ridge portions are lips formed by the head member that extend the length of the surface from which the bristles project.

8. A brush as in claim 7, wherein the projecting part of the handle portion includes a series of substantially parallel tines, the tines aligned for receipt within the series of grooves extending along the surface of the head portion, and retained within the grooves at least in part by the ridge portions.

9. A brush as in claim 8, wherein the lips are flexible, so that the tines may be moved from the grooves away from the surface and in the direction of the projection of the bristles.

10. A brush as in claim 6, wherein the ridge portions are comprised of at least one tab.

11. A brush as in claim 1, wherein the handle portion includes a ridge that interfaces with a recess in the head portion when the projecting part interfaces with the receiving part.

12. A brush as in claim 1, wherein the head portion includes a ridge that interfaces with a recess in the handle portion when the projecting part interfaces with the receiving part.

13. A brush comprising:

a) a head portion including a receiving part having a number of substantially parallel passages, the passages being at least partially enclosed, and an array of bristles extending away from a surface of the head portion; and b) a removable handle portion having a projecting part that interfaces with the receiving part of the head portion, the parallel passages of the receiving part being configured to receive the projecting part, the projecting part extendable through the array of bristles substantially adjacent the surface from which the bristles project and movable away from the surface in the direction of projection of the bristles;

wherein the movement of the projecting part away from the surface along the bristles removes material collected adjacent the surface and the bristles.

14. A brush as in claim 13, wherein the passages are completely enclosed.

15. A brush as in claim 1, wherein the passages are completely enclosed.

* * * * *